US010070738B1

(12) United States Patent
Royalty

(10) Patent No.: US 10,070,738 B1
(45) Date of Patent: Sep. 11, 2018

(54) CARRYING DEVICE AND METHOD OF USE

(71) Applicant: Nelson A. Royalty, Houston, TX (US)

(72) Inventor: Nelson A. Royalty, Houston, TX (US)

( * ) Notice: Subject to any disclaimer, the term of this patent is extended or adjusted under 35 U.S.C. 154(b) by 0 days.

(21) Appl. No.: 15/624,034

(22) Filed: Jun. 15, 2017

(51) Int. Cl.
*A61G 1/00* (2006.01)
*A47D 13/02* (2006.01)

(52) U.S. Cl.
CPC ..... *A47D 13/02* (2013.01)

(58) Field of Classification Search
CPC ..... A47D 13/02
USPC ..... 294/140, 141, 142, 150, 152, 156, 157, 294/165; 16/422, 426, 430
See application file for complete search history.

(56) References Cited

U.S. PATENT DOCUMENTS 3,096,917 A * 7/1963 Gudiksen ..... A47D 13/02 294/140
3,792,806 A * 2/1974 Layton ..... B65D 63/18 294/152
4,883,701 A 11/1989 Rankin
4,891,454 A 1/1990 Perdelwitz
4,944,057 A * 7/1990 Shaw ..... A61G 7/1023 224/159
5,333,769 A 8/1994 Skroski
6,669,289 B1 12/2003 Hays
6,745,399 B1 * 6/2004 Austin ..... A41B 13/103 2/49.1
6,978,479 B2 * 12/2005 Thach ..... A41B 13/065 2/111
7,284,790 B1 * 10/2007 Brewer ..... A47C 7/66 297/184.13
7,497,461 B2 3/2009 Emerson
7,806,471 B2 10/2010 Nishimoto
7,900,757 B2 * 3/2011 Sisitsky ..... A45C 1/024 150/113
8,118,364 B2 2/2012 Davis
8,365,325 B2 2/2013 Schneider
8,650,663 B2 * 2/2014 Fair ..... A47G 9/068 2/69.5
8,893,325 B2 11/2014 Arnold
9,032,572 B1 * 5/2015 Leach ..... A47D 15/003 5/655
9,049,946 B1 6/2015 Tyler
9,113,720 B2 8/2015 Bourgoin
9,307,845 B2 * 4/2016 Krass ..... A47D 13/02
9,351,586 B2 5/2016 Burkholder
2012/0018466 A1 * 1/2012 Topaz ..... A61G 1/01 224/158

* cited by examiner

*Primary Examiner* — Paul T Chin
(74) *Attorney, Agent, or Firm* — Ewing & Jones PLLC; Ira Domnitz

(57) ABSTRACT

A human carrying device with a first and second material unit that are joined together about a first side via an adhesion material; two straps disposed on said first material opposite said adhesion material; and two straps disposed on said second material opposite said adhesion material.

19 Claims, 5 Drawing Sheets

CARRYING DEVICE AND METHOD OF USE

CROSS-REFERENCE TO RELATED APPLICATIONS

Not applicable.

STATEMENT REGARDING FEDERALLY SPONSORED RESEARCH

Not applicable.

BACKGROUND

The present invention relates, in many embodiments, to a human carrying device and method of use.

The present invention is distinguished from the following art in many ways:

The present invention is distinguished from U.S. Pat. No. 4,883,701 to Rankin because Rankin is a car seat and not a transportation device or human carrier.

The present invention is distinguished from U.S. Pat. No. 4,891,454 to Perdelwitz because Perdelwitz is a car seat and not a transportation device or human carrier.

The present invention is distinguished from U.S. Pat. No. 5,333,769 to Skroski because Skroski is designed to be worn by a user and cannot be utilized with a car seat.

The present invention is distinguished from U.S. Pat. No. 6,669,289 to Hays because the invention of this patent serves as a barrier between human and a cart and cannot be used to transport a human from one location to another.

The present invention is distinguished from U.S. Pat. No. 7,497,461 to Emerson because Emerson is a hard-sided device that cannot transfer a sleeping human without disruption to a crib.

The present invention is distinguished from U.S. Pat. No. 7,806,471 to Nishimoto because Nishimoto is actually a cushion designed for a baby chair.

The present invention is distinguished from U.S. Pat. No. 8,118,364 to Davis because Davis is a blanket and not a transportation device.

The present invention is distinguished from U.S. Pat. No. 8,365,325 to Schneider because Schneider is a blanket with legs built in it.

The present invention is distinguished from U.S. Pat. No. 8,893,325 to Arnold because Arnold is a hard-structured bassinet and cannot transport a human to a crib undisturbed.

The present invention is distinguished from U.S. Pat. No. 9,049,946 to Tyler because Tyler is a blanket that can be secured to a device holding a human and is not a transportation device.

The present invention is distinguished from U.S. Pat. No. 9,113,720 to Bourgoin because Bourgoin is a hard-sided baby carrier.

The present invention is distinguished from U.S. Pat. No. 9,351,586 to Burkholder because Burkholder is a bed and not a transport device.

SUMMARY

In many embodiments, the present invention is a new and novel design for carrying an infant, child, or an adult. The present invention is advantageous over prior art by allowing the safe carrying of a sleeping human from a car seat, or the like to another location without waking the human.

In several embodiments, the present invention is: an improved infant carrying device comprising: a first and second material unit that are joined together about a first side via an adhesion material; two straps disposed on said first material opposite said adhesion material; and two straps disposed on said second material opposite said adhesion material. In some embodiments, the invention further comprises: said two straps disposed on said first material opposite said adhesion material are mechanically engaged with each other distal to said first material. In several embodiments said two straps disposed on said second material opposite said adhesion material are mechanically engaged with each other distal to said second material. In several embodiments, the invention comprises said two straps disposed on said first material opposite said adhesion material are fitted with clasping mechanisms distal to said first material. In some embodiments, the present invention comprises: said two straps disposed on said second material opposite said adhesion material are fitted with clasping mechanisms distal to said second material. In some embodiments, the invention comprises: said first unit material further comprises a skull cap attached to said first unit material. In some embodiments, the present invention further comprising: said second unit material further comprises a skull cap attached to said second unit material. In some embodiments, the present invention further comprises: said first and second unit materials are pliable. In some embodiments, the comprising: said first and second unit materials are constructed with flaps and slits distal to the adhesive units. An improved method for carrying an infant utilizing a carrying device comprising the steps of: obtaining a carrying device comprising; a first and second material unit that are joined together about a first side via an adhesion material; two straps disposed on said first material opposite said adhesion material; and two straps disposed on said second material opposite said adhesion material; placing an infant on said first and second material units; and lifting said infant by pulling on said two straps disposed on said first material opposite said adhesion material; and said two straps disposed on said second material opposite said adhesion material.

BRIEF DESCRIPTION OF THE DRAWINGS

For a more complete understanding of the present disclosure, and the advantages thereof, reference is now made to the following descriptions to be taken in conjunction with the accompanying drawings describing specific embodiments of the disclosure, wherein.

DETAILED DESCRIPTION

Figure 1:
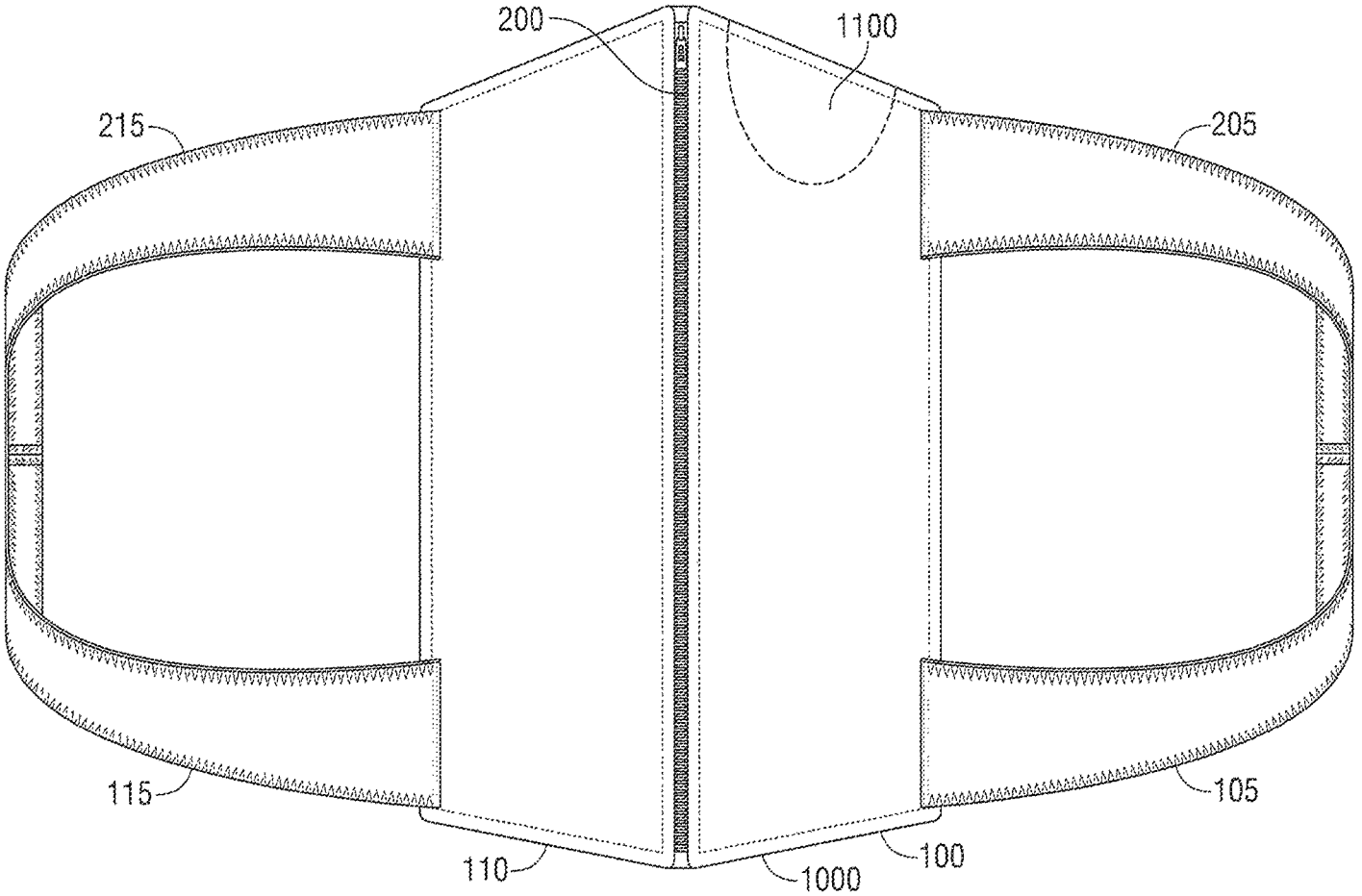
FIG. 1 is the bottom view of one embodiment of the present invention.

One or more illustrative embodiments incorporating the invention disclosed herein are presented below. Applicant has created a revolutionary and novel carrying device and method of use of the same. In some embodiments, the present invention can carry any size human.

In the following description, certain details are set forth such as specific quantities, sizes, etc. so as to provide a thorough understanding of the present embodiments disclosed herein. However, it will be evident to those of ordinary skill in the art that the present disclosure may be practiced without such specific details. In many cases, details concerning such considerations and the like have been omitted inasmuch as such details are not necessary to obtain a complete understanding of the present disclosure and are within the skills of persons of ordinary skill in the relevant art.

Referring to the drawings in general, it will be understood that the illustrations are for the purpose of describing particular embodiments of the disclosure and are not intended to be limiting thereto. Drawings are not necessarily to scale and arrangements of specific units in the drawings can vary.

While most of the terms used herein will be recognizable to those of ordinary skill in the art, it should be understood, however, that when not explicitly defined, terms should be interpreted as adopting a meaning presently accepted by those of ordinary skill in the art. In cases where the construction of a term would render it meaningless or essentially meaningless, the definition should be taken from Webster's Dictionary, 11th Edition, 2008. Definitions and/or interpretations should not be incorporated from other patent applications, patents, or publications, related or not, unless specifically stated in this specification or if the incorporation is necessary for maintaining validity. Specifically, defined terms: "Adhesion material(s)" as used herein can be any type of material or device utilized to join two solid pieces of material together. "Skull cap" as used herein can be any type of materials used to support the head of a human or baby. "Skull cap" can also be references as a "crescent shaped bolster". "Infant" as used herein can be any young human ranging from age newborn –2.5 years and/or a human under 40 pounds.

Certain terms are used in the following description and claims to refer to particular system components. As one skilled in the art will appreciate, different persons may refer to a component by different names. This document does not intend to distinguish between components that differ in name but not function. The drawing figures are not necessarily to scale. Certain features of the invention may be shown exaggerated in scale or in somewhat schematic form, and some details of conventional elements may not be shown, all in the interest of clarity and conciseness.

Although several preferred embodiments of the present invention have been described in detail herein, the invention is not limited hereto. It will be appreciated by those having ordinary skill in the art that various modifications can be made without materially departing from the novel and advantageous teachings of the invention. Accordingly, the embodiments disclosed herein are by way of example. It is to be understood that the scope of the invention is not to be limited thereby.

In several embodiments of the present invention, it is envisioned that the invention could be scaled up, or down, so as to accommodate various sizes and weight of a human. In several embodiments of the present invention, it is envisioned that the invention is designed to be utilized with infants.

FIG. 1 illustrates a bottom view of one embodiment of the present invention. As shown, the human carrying device 1000 can be comprised of two material units 100 and 110 that are joined together about one side via adhesion material 200. As shown, adhesion material 200 can be, but is not limited to a zipper or other adhesion material as is known in the art for releasably joining two materials together. Adhesion material 200 can be of sufficient strength as to allow for tension between material units 100 and 110 as to support the weight of a child or infant. In several embodiments material units 100 are solid, or mesh materials capable of supporting the weight of a child or infant when in operation. In many embodiments, material units 100 and 110 are designed to be pliable as to support a child's body when in operation. Material units 100 and adhesion material 200 can be of variant geometric shape and density.

As also illustrated, in some embodiments, attached to material unit 100 and opposite adhesion material 200 are straps 205 and 105. Straps 205 and 105 are preferably designed to allow for grasping by a user and also designed to support the weight of a child or infant in use. As also illustrated, in some embodiments, attached to material unit 110 and opposite adhesion material 200 are straps 215 and 115. Straps 215 and 115 are preferably designed to allow for grasping by a user and also designed to support the weight of a child or infant in use. In several embodiments, straps 205, 105, 215, and 115 are made of a pliable material. In several embodiments, straps 205, 105, 215, and 115 can be constructed to have variable lengthening capabilities.

Figure 2:
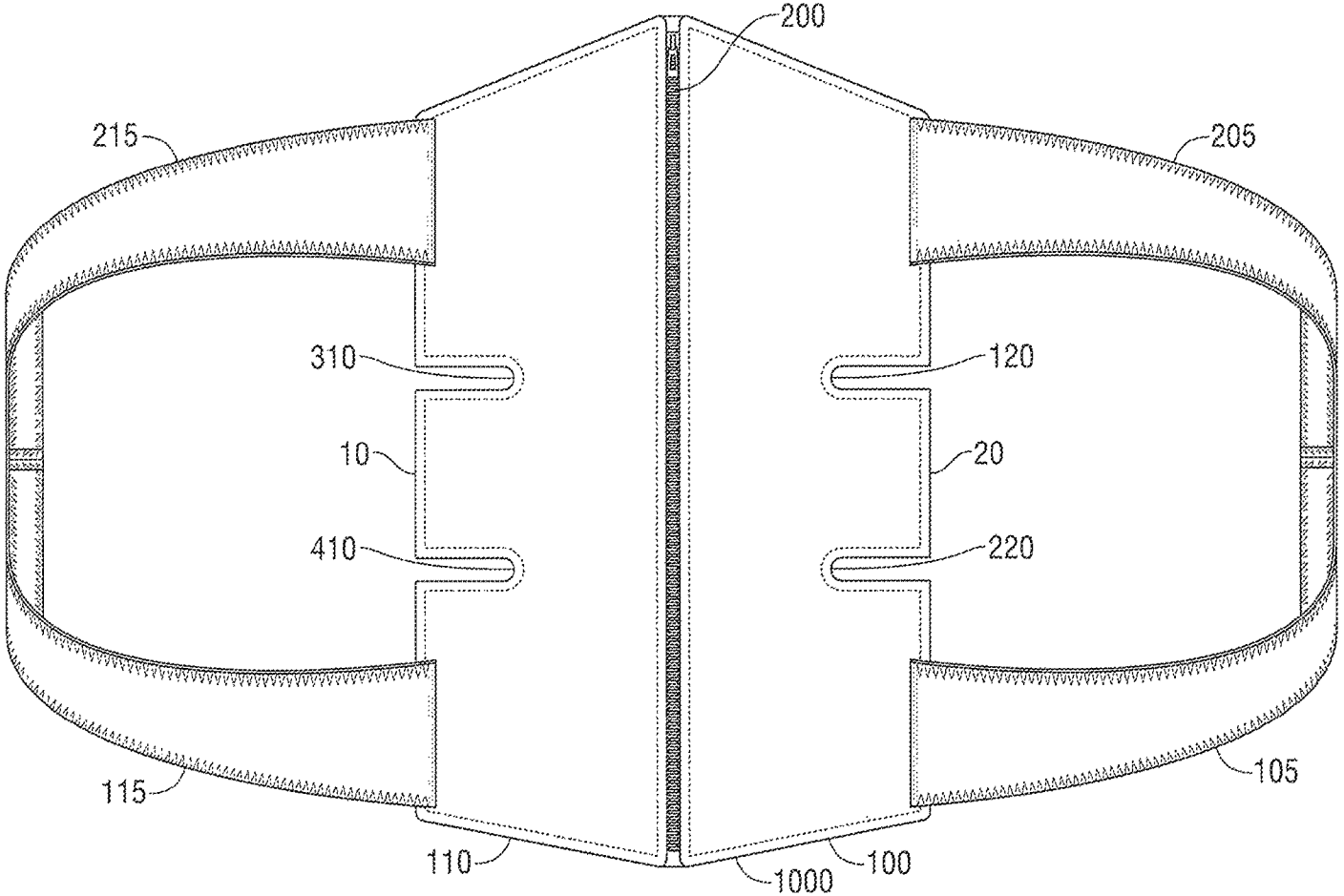
FIG. 2 is the bottom view of one embodiment of the present invention with material inlets.

FIG. 2 illustrates a bottom view of one embodiment of the present invention. As shown, the carrying device 1000 can be comprised of two material units 100 and 110 that are joined together about one side via adhesion material 200. As shown, adhesion material 200 can be, but is not limited to a zipper or other adhesion material as is known in the art for releasably joining two materials together. Adhesion material 200 can be of sufficient strength as to allow for tension between material units 100 and 110 as to support the weight of a human. In several embodiments material units are solid, or mesh materials capable of supporting the weight of a human when in operation. In many embodiments, material units 100 and 110 are designed to be pliable as to support a human's body when in operation.

As illustrated in some embodiments there are flaps 20 and 10 as well as slits 120, 220, 310 and 410 that are designed to allow the carrier 1000 to be placed onto a car seat, or the like and to be secured through placement of car seat straps through the slits 120, 220, 310 and 410 via movement of flaps 20 and 10.

As also illustrated, in some embodiments, attached to material unit 100 and opposite adhesion material 200 are straps 205 and 105. Straps 205 and 105 are preferably designed to allow for grasping by a user and also designed to support the weight of a human in use. As also illustrated, in some embodiments, attached to material unit 110 and opposite adhesion material 200 are straps 215 and 115. Straps 215 and 115 are preferably designed to allow for grasping by a user and also designed to support the weight of a human in use. In several embodiments, straps 205, 105, 215, and 115 are made of a pliable material.

Figure 3:
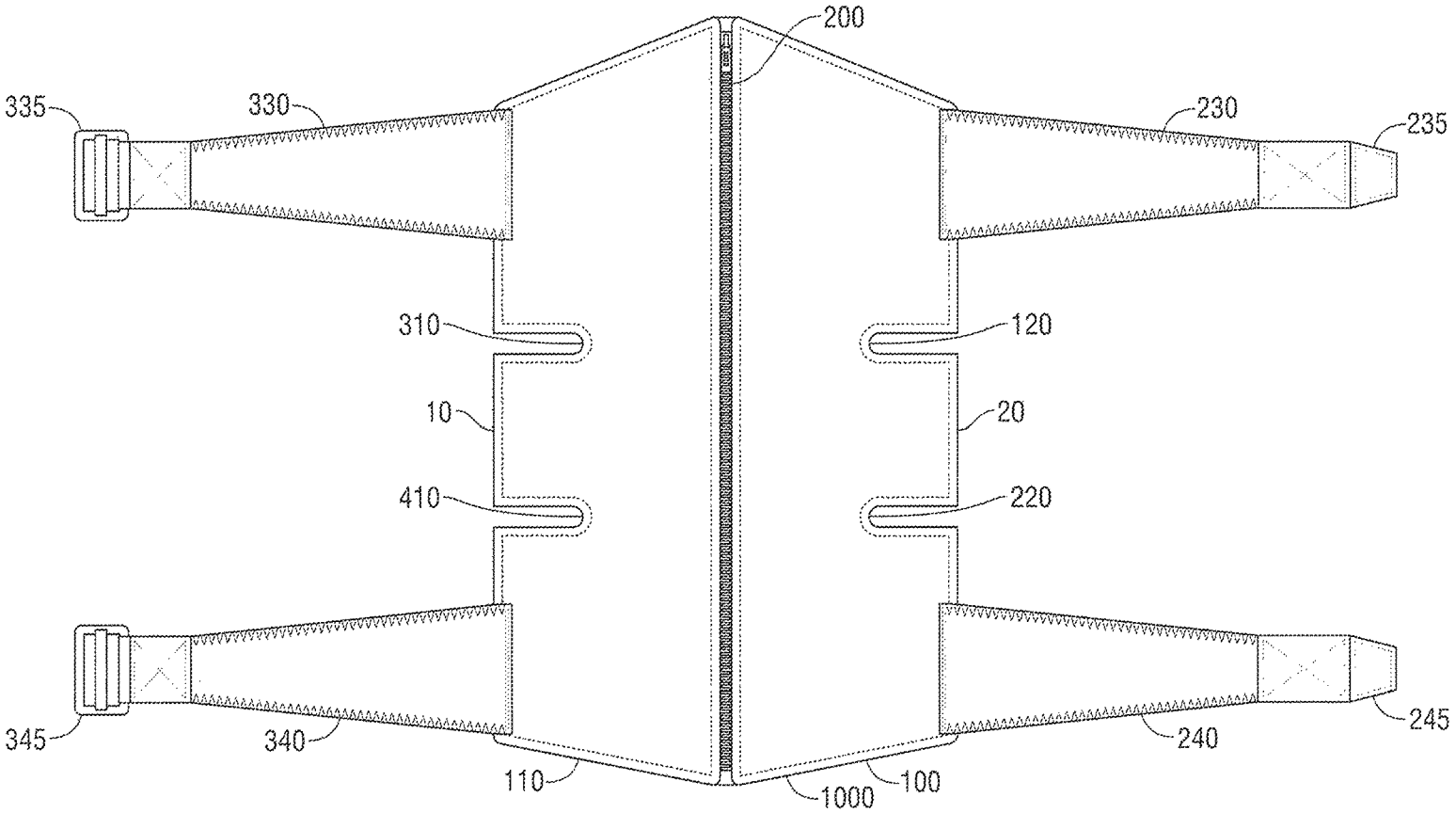
FIG. 3 is the bottom view of one embodiment of the present invention with material inlets and alternative attachment handles.

FIG. 3 illustrates a bottom view of one embodiment of the present invention. As shown, the human carrying device 1000 can be comprised of two material units 100 and 110 that are joined together about one side via adhesion material 200. As shown, adhesion material 200 can be, but is not limited to a zipper or other adhesion material as is known in the art for releasably joining two materials together. Adhesion material 200 can be of sufficient strength as to allow for tension between material units 100 and 110 as to support the weight of a human. In several embodiments material units are solid, or mesh materials capable of supporting the weight of a when in operation. In many embodiments, material units 100 and 110 are designed to be pliable as to support a human's body when in operation.

As illustrated in some embodiments there are flaps 20 and 10 as well as slits 120, 220, 310 and 410 that are designed to allow the carrier 1000 to be placed onto a car seat, or the like and to be secured through placement of car seat straps through the slits 120, 220, 310 and 410 via movement of flaps 20 and 10.

As illustrated, in this embodiment, there are two straps 230 and 240 with end male clasp parts 235 and 245 respectively these are attached to unit 100. Straps 230 and 240 with end male clasp parts 235 and 245 are preferably designed to be able to maintain the weight of a human when in use. As illustrated, in this embodiment, there are two straps 330 and 340 with end female clasp parts 335 and 345 respectively these are attached to unit 110. Straps 330 and 340 with end female clasp parts 335 and 345 are preferably designed to be able to maintain the weight of a human when in use. As shown, male clasp parts 235 and 245 can be interchangeably located on respective straps 230, 240, 330 and 340 as known in the art and can also be comprised of any clasping, or adhesion devices as are known in the art.

Figure 4:
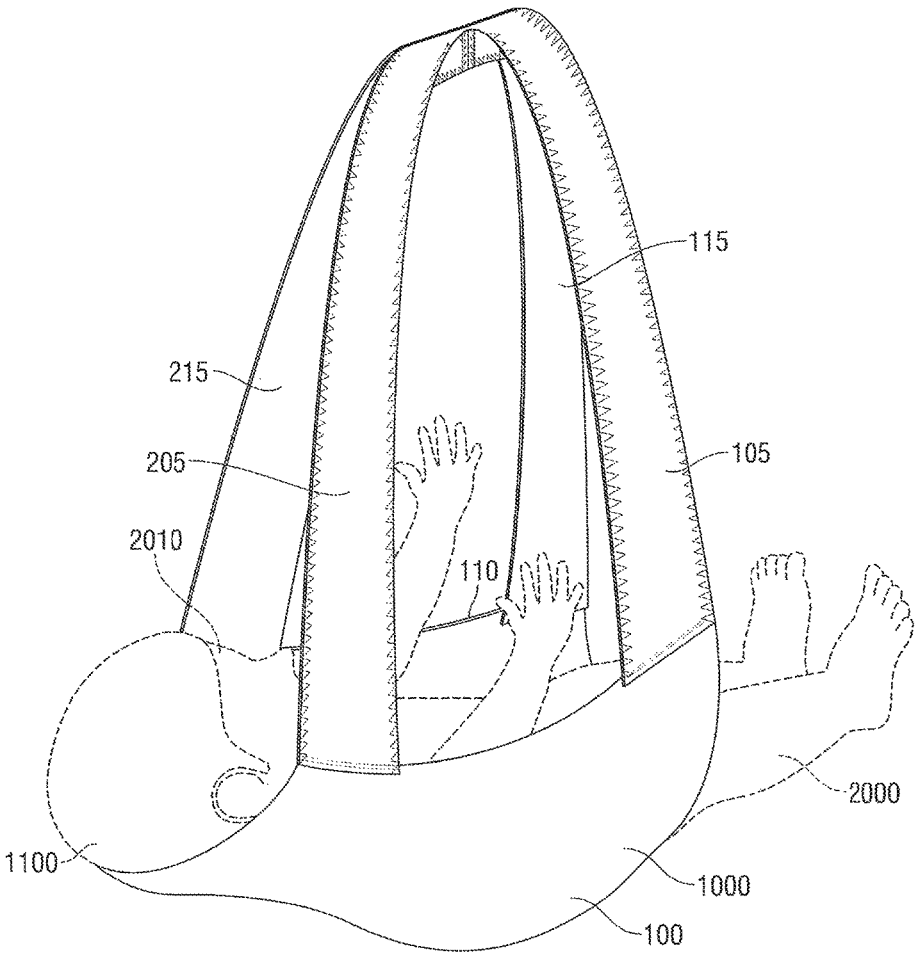
FIG. 4 is a side view of one embodiment of the present invention with an infant being held.

FIG. 4 illustrates one embodiment of the present invention in use holding an infant. As shown, infant 2000 is nestled into the human carrier 1000 with the predominant part of its body being held by the units 100 and 110 (not shown). In this embodiment, there is an optional skull cap 1100 that can extend from the unit 100 or 110 that is nearest to straps 205 and 215 such that additional support is provided to the infant's head 2000 when the device is in use. As shown, in operation, straps 205, 215, 115 and 105 pull up and over the infant 2000 therein cradling said infant 2000 when in use. In many embodiments, the "skull cap" may better be described as a "crescent shaped bolster" located at the top of the device. In several embodiments, the material used to make skull cap 1100 would have enough stretch to it that it more or less supports the head and body of a user. In many embodiments of the present invention, the skull cap 1100 would serve as added support and an indicator as to where an infant's head should be before someone attempts to lift the infant using the device. In several embodiments of the present invention, it is envisioned that the invention could be scaled up, or down, so as to accommodate various sizes and weight of a human. In several embodiments of the present invention, it is envisioned that the invention is designed to be utilized with infants. Although the human illustrated is an infant 2000, any size human could work for several embodiments of the present invention.

Figure 5:
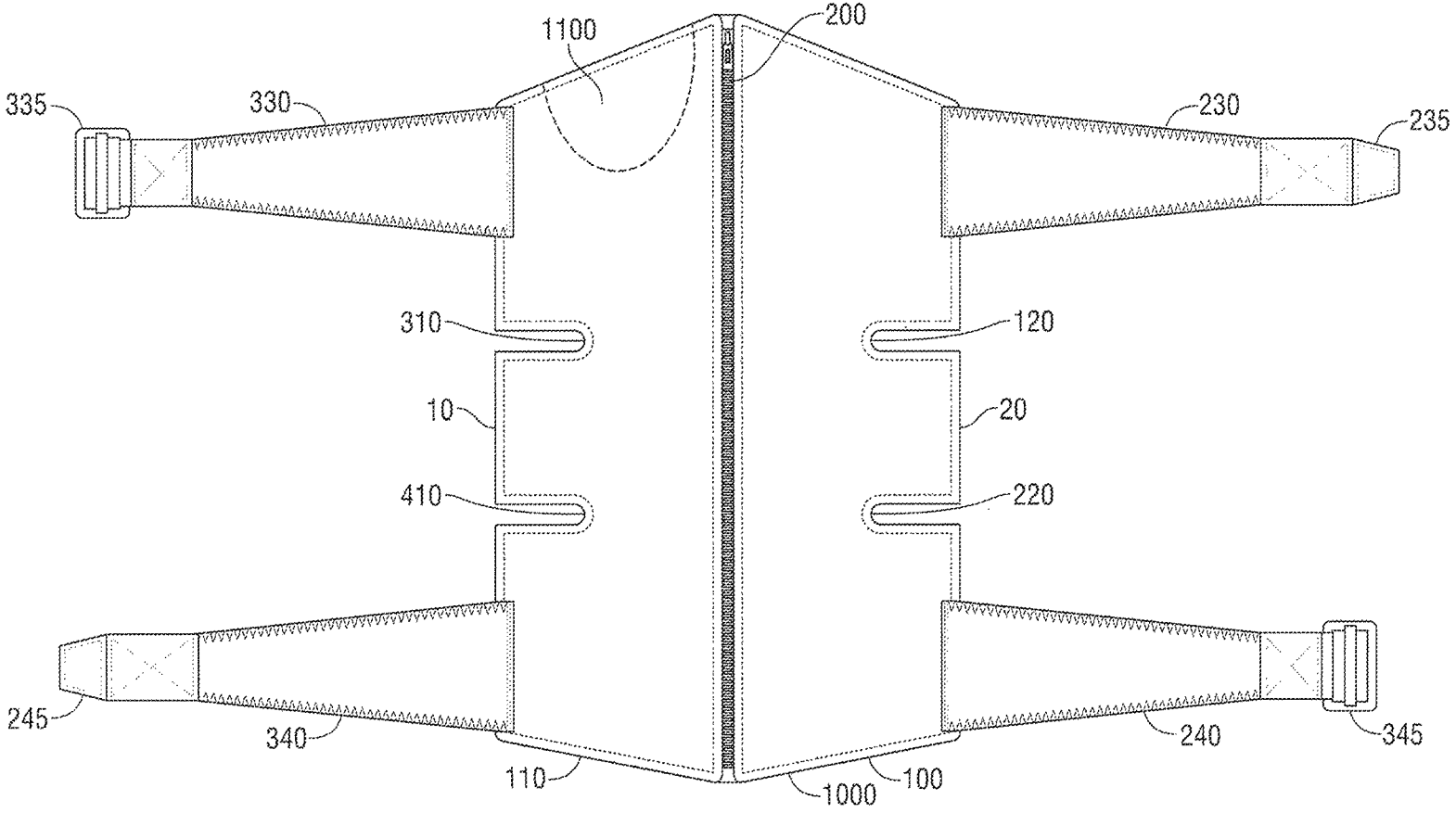
FIG. 5 is the bottom view of one embodiment of the present invention with material inlets and alternative attachment handles.

FIG. 5 illustrates a bottom view of one embodiment of the present invention. As shown, the human carrying device 1000 can be comprised of two material units 100 and 110 that are joined together about one side via adhesion material 200. As shown, adhesion material 200 can be, but is not limited to a zipper or other adhesion material as is known in the art for releasably joining two materials together. Adhesion material 200 can be of sufficient strength as to allow for tension between material units 100 and 110 as to support the weight of a human. In several embodiments material units are solid, or mesh materials capable of supporting the weight of a human when in operation. In many embodiments, material units 100 and 110 are designed to be pliable as to support a human's body when in operation. In many embodiments, adhesion material 200 can be a zipper, or other joining material mechanism as is known in the art.

As illustrated in some embodiments there are flaps 20 and 10 as well as slits 120, 220, 310 and 410 that are designed to allow the carrier 1000 to be placed onto a car seat, or the like and to be secured through placement of car seat straps through the slits 120, 220, 310 and 410 via movement of flaps 20 and 10.

As illustrated, in this embodiment, there are two straps 230 and 240 with end male clasp parts 235 and 245 respectively these are attached to unit 100. Straps 230 and 240 with end male clasp parts 235 and 245 are preferably designed to be able to maintain the weight of a human when in use. As illustrated, in this embodiment, there are two straps 330 and 340 with end female clasp parts 335 and 345 respectively these are attached to unit 110. Straps 330 and 340 with end female clasp parts 335 and 345 are preferably designed to be able to maintain the weight of a human when in use. As shown, male clasp parts 235 and 245 can be interchangeably located on respective straps 230, 240, 330 and 340 as known in the art and can also be comprised of any clasping, or adhesion devices as are known in the art.

While preferred embodiments have been shown and described, modifications thereof can be made by one skilled in the art without departing from the scope or teaching herein. The embodiments described herein are exemplary only and are not limiting. Many variations and modifications of the system and apparatus are possible and will become apparent to those skilled in the art once the above disclosure is fully appreciated. For example, the relative dimensions of various parts, the materials from which the various parts are made, and other parameters can be varied. Accordingly, it is intended that the following claims be interpreted to embrace all such variations and modifications.

I claim:

1. An improved method for carrying an infant utilizing a carrying
device comprising the steps of:
obtaining a carrying device comprising;
a first and second material unit that are joined together only about a first side via an adhesion material wherein said adhesion material can disjoin allowing materials to pass between said first and second materials;
two straps disposed on said first material opposite said adhesion material; and
two straps disposed on said second material opposite said adhesion material;
placing an infant on said first and second material units; and
lifting said infant by pulling on said two straps disposed on said first material opposite said adhesion material; and two straps disposed on said second material opposite said adhesion material.

2. The improved method for carrying an infant utilizing a carrying device of claim 1 further comprising the steps of:
mechanically engaging said two straps disposed on said second material opposite said adhesion material with each other distal to said second material.

3. The improved method for carrying an infant utilizing a carrying device of claim 1 further comprising the steps of:
mechanically engaging said two straps disposed on said first material opposite said adhesion material with each other distal to said first material.

4. The improved method for carrying an infant utilizing a carrying device of claim 1 further comprising the steps of:
attaching a skull cap to said first unit material.

5. The improved method for carrying an infant utilizing a carrying device of claim 1 further comprising the steps of:
attaching a skull cap to said second unit material.

6. An improved infant carrying and removing device comprising:

a first material unit with a first front, a first back and a first edge;

said first material further comprising a first adhesion material about said first edge;

a second material unit with a second front, a second back and a second edge;

said second material further comprising a second adhesion material about said second edge; wherein said first adhesion material releasably engages with second adhesion material therein forming a unity between said first material and said second material;

two straps disposed on said first material opposite said first adhesion material;

two straps disposed on said second material opposite said second adhesion material;

wherein;

an object is supportable by said unity about said first front and said second front and vertical movement of said straps disposed on said first material opposite said first adhesion material and said two straps disposed on said second material opposite said second adhesion material; and wherein an object is removable from said unity by releasably disengaging said first adhesion material from said second adhesion material in which said object passes through said first back of said first material and said second back of said second material.

7. The improved infant carrying device of claim 6 further comprising:

said two straps disposed on said first material opposite said adhesion material are mechanically engaged with each other distal to said first material.

8. The improved infant carrying device of claim 6 further comprising:

said two straps disposed on said second material opposite said adhesion material are mechanically engaged with each other distal to said second material.

9. The improved infant carrying device of claim 6 further comprising:

said two straps disposed on said first material opposite said adhesion material are fitted with clasping mechanisms distal to said first material.

10. The improved infant carrying device of claim 6 further comprising:

said two straps disposed on said second material opposite said adhesion material are fitted with clasping mechanisms distal to said second material.

11. The improved infant carrying device of claim 6 further comprising:

said first unit material further comprises a skull cap attached to said first unit material.

12. The improved infant carrying device of claim 4 further comprising:

said second unit material further comprises a skull cap attached to said second unit material.

13. The improved infant carrying device of claim 6 further comprising:

said first and second unit materials are pliable.

14. The improved infant carrying device of claim 1 further comprising:

said first and second unit materials are constructed with flaps and slits distal to the adhesive units.

15. An improved method for carrying and removing an infant utilizing a carrying device comprising the steps of:

obtaining a carrying device comprising;

a first material unit with a first front; a first back and a first edge;

said first material further comprising a first adhesion material about said first edge;

a second material unit with a second front, a second back and a second edge;

said second material further comprising a second adhesion material about said second edge; wherein said first adhesion material releasably engages said second adhesion material therein forming a unity between said first material and said second material;

two straps disposed on said first material opposite said first adhesion material;

two steps disposed on said second material opposite said second adhesion material; wherein;

an object is supportable by said unity about said first front and said second front and vertical movement of said two straps disposed on said first material opposite said first adhesion material and said two straps disposed on said second material opposite said second adhesion material; and wherein an object is removable from said unity by releasably disengaging said first adhesion material from said second adhesion material in which said object passes through said first back of said first material and said second back of said second material;

placing an infant on said unity; and lifting said object by pulling on said two straps disposed on said first material opposite said adhesion material; and two straps disposed on said second material opposite said adhesion material.

16. The improved method for carrying an infant utilizing a carrying device of claim 15 further comprising the steps of:

mechanically engaging said two straps disposed on said second material opposite said adhesion material with each other distal to said second material.

17. The improved method for carrying an infant utilizing a carrying device of claim 1 further comprising the steps of:

mechanically engaging said two straps disposed on said first material opposite said adhesion material with each other distal to said first material.

18. The improved method for carrying an infant utilizing a carrying device of claim 15 further comprising the steps of:

attaching a skull cap to said first unit material.

19. The improved method for carrying an infant utilizing a carrying device of claim 15 further comprising the steps of:

attaching a skull cap to said second unit material.

* * * * *